US006293592B1

(12) United States Patent
Robertson et al.

(10) Patent No.: US 6,293,592 B1
(45) Date of Patent: Sep. 25, 2001

(54) GREETING CARD CONSTRUCTION AND METHODS OF MAKING AND USING SAME

(75) Inventors: David Robertson, Santa Rosa; Len A. Lyberger, Palos Verdes, both of CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/388,102

(22) Filed: Sep. 1, 1999

(51) Int. Cl.[7] ..... B42D 15/00

(52) U.S. Cl. ..... 283/117; 283/61; 283/56; 40/124.11

(58) Field of Search ..... 281/2, 5; 283/61, 283/62, 107–111, 101, 105, 56, 74, 75, 117; 40/124.11, 144.01

(56) References Cited

U.S. PATENT DOCUMENTS 4,006,048 2/1977 Cannady, Jr. et al. .
4,873,135 10/1989 Wittnebel et al. .
4,940,690 7/1990 Skees .
5,273,796 12/1993 Elbing et al. .
5,536,545 7/1996 Condon et al. .
5,829,790 11/1998 Phillips .

*Primary Examiner*—Willmon Fridie, Jr.
(74) *Attorney, Agent, or Firm*—Oppenheimer Wolff & Donnelly LLP

(57) ABSTRACT

A sheet construction has side-by-side first and second panels separated from one another by a fold line. In a single pass through a printer or copier normal-orientation (first) indicia is printed on the first panel and reverse-orientation (second) indicia is printed on the second panel on the same (first) face of the sheet construction as the normal-orientation indicia. The second panel, but not the first panel, has a backlit film construction such that the reverse-orientation indicia shows through the second panel clearly as normal-orientation (second) indicia on the opposite (second) face. The sheet construction is then folded on the fold line to form a printed half-fold card. Thereby, the first face of the second panel (which has the normal-orientation (second) indicia) defines the front cover of the printed card and the second face of the first panel (which has the normal-orientation (first) indicia) defines the inside of the printed card.

26 Claims, 6 Drawing Sheets

GREETING CARD CONSTRUCTION AND METHODS OF MAKING AND USING SAME

BACKGROUND OF THE INVENTION

The present invention relates to printable greeting card constructions, methods of forming printed cards, and methods of making printable card constructions.

Greeting cards printed using today's desktop printers and personal computers are popular products for conveying information and self-expression. Presently, to create a half-fold card requires printing the desired indicia for the outer panels in one pass through the printer and then reloading and printing the interior panels in a second pass therethrough. Unfortunately, this multi-step procedure is tedious and can lead to spoilage of sheets if the sheets are loaded in the improper orientation for the second pass. Although quarter-fold cards with their second fold do not suffer from this problem, the resulting card is only half as large. Thus, the quarter-fold cards are clearly smaller than common, pre-printed greeting cards, and are undesirable for most uses.

SUMMARY OF THE INVENTION

Directed to remedying problems of the prior art greeting card constructions and printing methods, disclosed herein is a conventional size, half-fold greeting card construction which has the desired indicia printed on both the outer and interior card panels in a single pass through a printer or copier. The sheet construction includes a first panel, a second panel and fold line between the two panels. The first panel is printable with a normal-orientation indicia on the first face of the sheet construction. And the second panel is printable with a reverse-printed indicia on the first face of the sheet construction; the reverse-printed indicia because of the backlit construction of the second panel is visible on the opposite second face of the sheet construction. In other words, the normal-orientation and reverse-printed indicia are thus printed on the same face of the sheet construction in a single pass through a printer or copier. The printed sheet construction is then folded on the fold line so that the reverse-printed indicia is on the front of the card in a normal orientation and the normal-orientation indicia is on the inside surface with the folded card open.

A preferred sheet construction uses a transparent film base sheet, whose bottom surface defines the second face of the sheet construction. A backlit coating is applied to the entire top surface of the base sheet. When ink (such as from an ink jet printer) is applied to the top of the coating on a second portion or panel of the sheet construction, the ink (due to the special properties of the coating) migrates through the coating to the interface with the base sheet, that is, to the top of the base sheet. Since the base sheet comprises a transparent film, the ink is visible through the film on the bottom surface thereof. In other words, when the ink is applied as reverse-printed indicia on the top of the coating, it is visible as normal orientation indicia on the bottom of the film, i.e., the second face of the sheet construction. An opaque, direct-imaging material, such as a sheet of paper, is applied with adhesive to a top surface of the coating to define the first panel. The first and second panels are separated by a fold line, such as a scored line on the coating.

An alternative sheet construction does not extend the backlit coating across the entire top surface of the base sheet. Rather, the backlit coating (or reverse-printable, backlit formulation) is extrusion-coated or coextruded in side-by-side stripes (or panels) with an opaque, imageable film on a transparent continuous base film. A space between the stripes forms the fold line of the sheet construction between the panels.

For certain card uses or embodiments it may be desirable to cover up the reverse-printed side of the first face of the second panel for the final folded card construction. Accordingly, provided herein is a further construction that includes a pocket over the first face of the second panel and an opaque panel positionable in the pocket after the printing operation.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
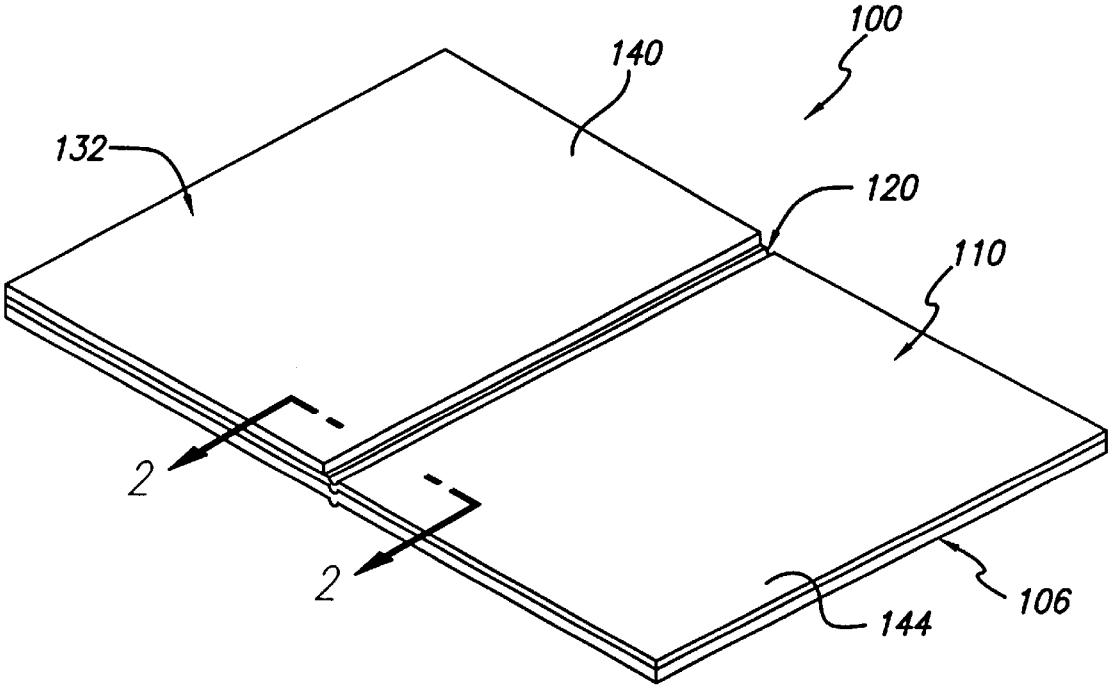
FIG. 1 is a perspective view of a composite imageable sheet construction of the present invention.
Figure 2:
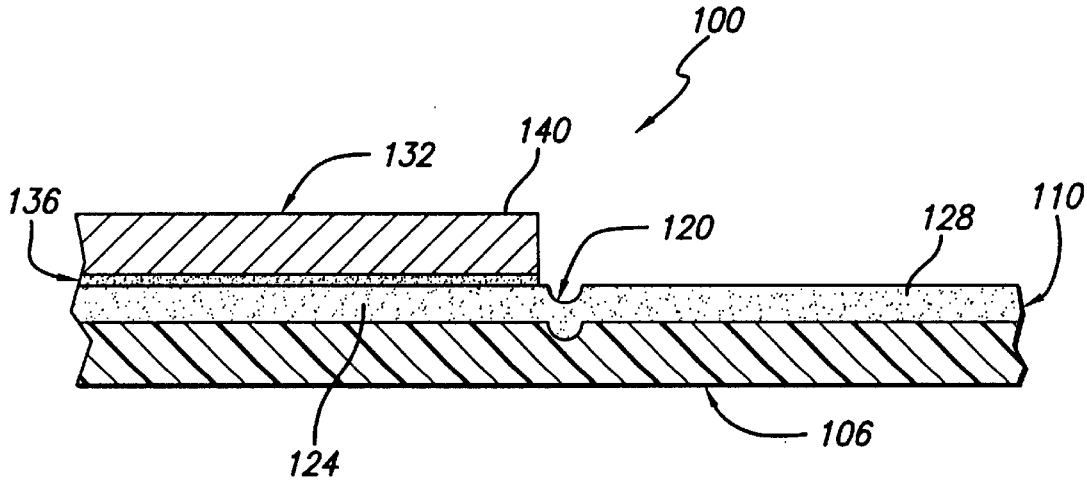
FIG. 2 is an enlarged cross-sectional view taken on line 2—2 of FIG. 1.

Referring to FIGS. 1 and 2, a first printable card construction of the present invention is illustrated generally at 100. The construction 100 includes a transparent film 106 having a coating 110 covering its entire upper surface. The coating 110 is partially opaque and readily accepts ink jet inks; it has the characteristic that inks absorb into it and migrate to the interface of the coating with the base sheet such that they are visible from the opposite side of the sheet. The coating 110 in the trade is referred to alternatively as "a five mil backprint polyester film," "clear or translucent film," and "reverse reading inkjet film with polyester base, one side coated matte." This type of backlit coating 110 or construction produces images that are not only visible, but are also remarkably vivid and glossy and are protected from damage by moisture and ultraviolet light by the base film barrier. These backlit films (106, 110) are commercially available from sources such as Azon, Arkwright and Rexam. They are referred to by different prominent suppliers as "backprint film," "film for backlit display," and "backlit film and display."

A fold line 120 separates the film 106 with coating 110 thereon into two portions or panels 124, 128. The fold line 120 can be created, for example, by scoring or using a perfing wheel. A sheet of opaque, direct-imaging material 132, such as sheet of paper, is attached by means of an adhesive layer 136, for example, on the first portion 124 to define the first panel 140. The second portion 128 is not covered, but rather the backlit coating 110 defines the second panel 144. The opaque, direct imaging material 132 can be any good imaging paper, preferably having a thickness in the range of three to seven mils. Examples are 24# (90 g/m$^2$) Jet Print Ultra from Hammermill Papers, 28# (105 g/m$^2$) Cougar Opaque from Weyerhauser Paper, and 24# (90 g/m$^2$) Uncoated Ink Jet from Boise Cascade.

The preferred dimensions of the sheet construction 100 are standard sheet sizes, namely, letter size (8.5 by eleven inch), legal size (8.5 inch by fourteen inch) or A4 size (210 mm by 297 mm). The size typically depends on the local standards. Other sized sheets that can be passed through printers, trays and feeds can also be used as desired.

Figure 4:
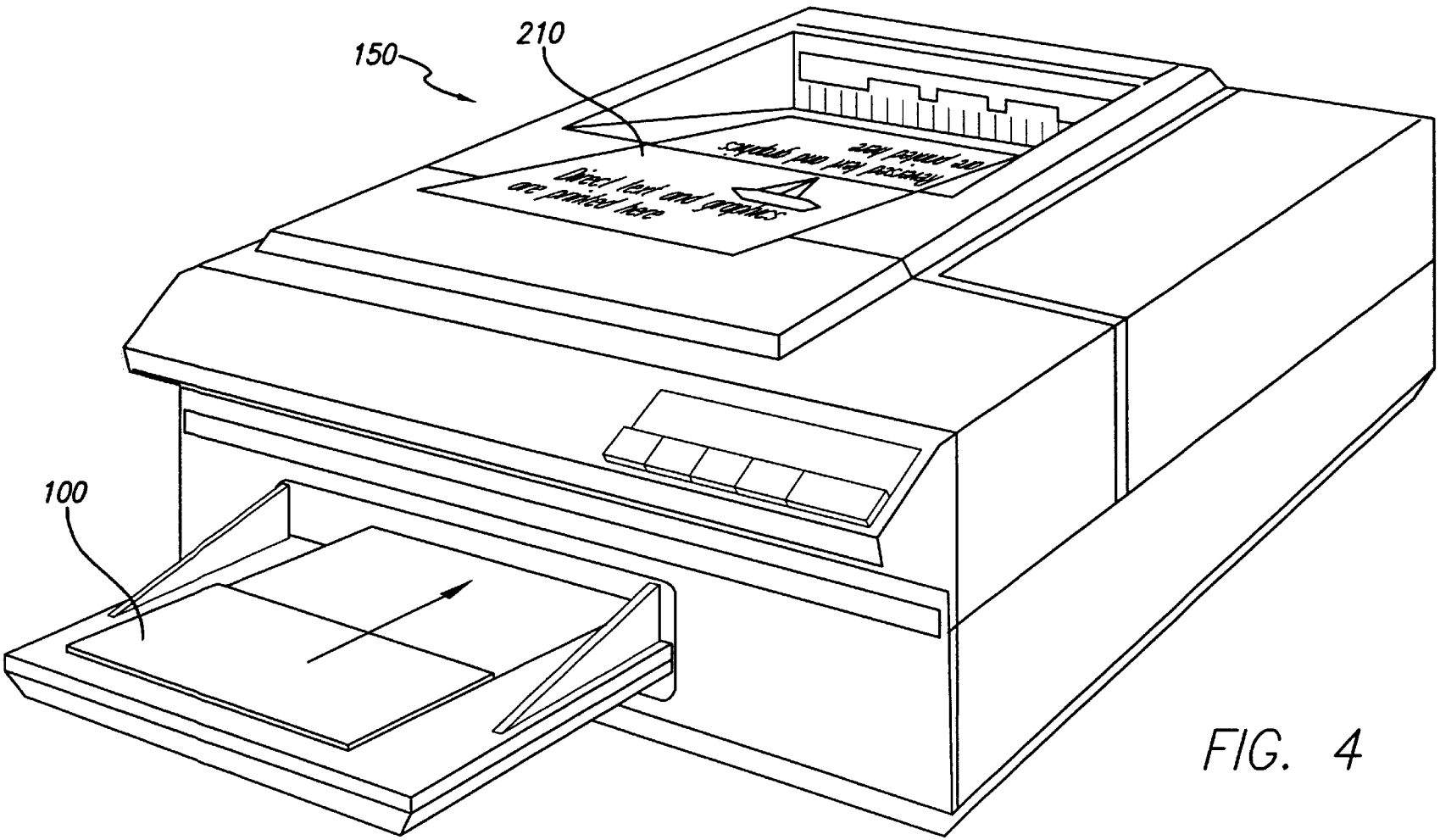
FIG. 4 is a perspective view showing the sheet construction of FIG. 1 (or 3) being fed into a printer or copier for a printing operation thereon.

The total thickness of the composite sheet 100 preferably should not exceed eleven mils so that it can pass through the printer 150 (FIG. 4). More specifically, the thickness should be between five and nine mils for best perceived stiffness, opacity and strength consistent with printer runability. The thickness of the film component 106 preferably should be between four to six mils with the opaque or paper component 132 being between three and seven mils, depending on the exact architecture chosen. Since the film 106 is typically more expensive than the paper 132, the minimum film thickness that delivers acceptable manufacturability and consumer aesthetics (stiffness, opacity and "hand") should be used. While a film 106 that is two mils thick would likely be flexible, films thicker than about five or six mils would be wasteful. Accordingly, a film thickness on the order of four to six mils is preferred. For the paper 132, opacity becomes generally unacceptably low below about three mils. And when the paper 132 is more than seven mils thick, the total thickness of the laminate 100 is excessive as for example where the film 106 is five mils and the laminating adhesive 136 is one mil thick.

Figure 3:
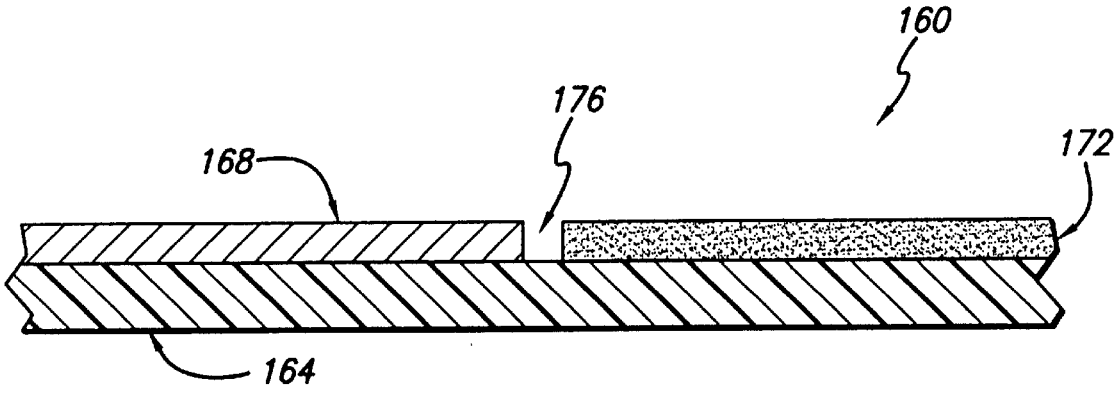
FIG. 3 is a view similar to FIG. 2 showing an alternative sheet construction of the present invention.

A printable card construction of the present invention, which is an alternative to the paper-film laminate construction 100 of FIGS. 1 and 2, is illustrated in cross-section in FIG. 3 generally at 160. Referring thereto, a transparent, continuous base film 164 is provided. Side-by-side stripes of an opaque, imageable film 168 and a reverse-printable backlit formulation 172 are preferably extrusion-coated or coextruded on top of the film 164. Films can also be coated by other means such as from solutions and emulsions. A gap 176 between the stripes forms the fold line or the hinge to enable folding of the two stripes or panels 168, 172 after printing to form the card construction.

That is, in the above-described alternative construction 160 of FIG. 3, two coatings 168, 172 are applied side-by-side on a transparent base film 164—one is a translucent (backprint) coating and the other is an opaque direct-print coating. The total thickness of this construction 160 is preferably just four to six mils or so since no separate layer is laminated to the film.

The sheet construction 100 (or 160) is fed into a printer or copier 150, such as shown in FIG. 4. The printer or copier 150 can be a desktop color inkjet printer, which is the preferred imager for this greeting card application. However, color laser printers can be used in conjunction with transparent film and so can monochrome laser printers and copiers.

Figure 6:
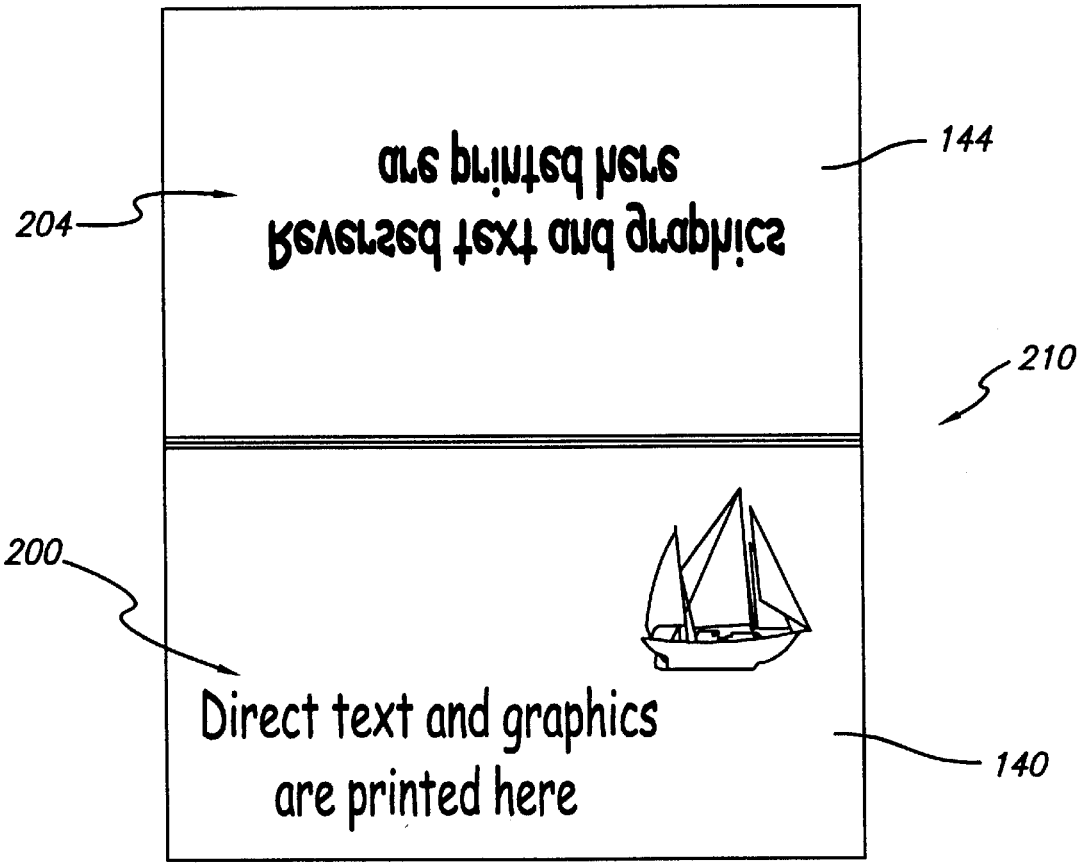
FIG. 6 is a top plan view of a sheet construction of the invention after the printing operation.
Figure 7:
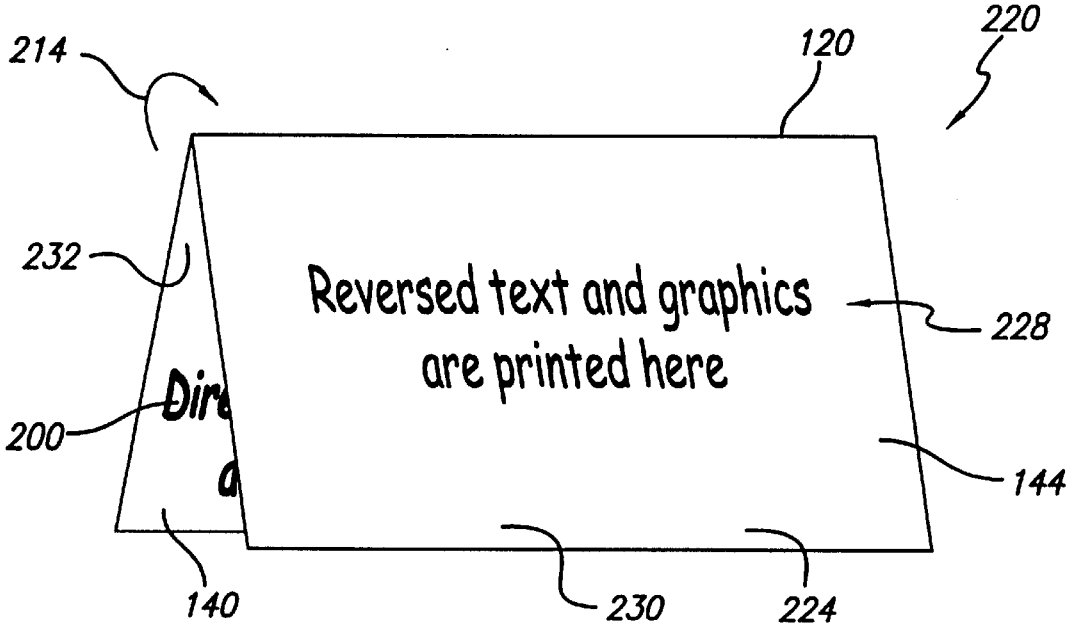
FIG. 7 is a perspective view of the printed sheet construction of FIG. 6 after a folding operation thereon.

The sheet construction 100 (or 160) after passing through the printer or copier 150 and the printing operation performed thereon is depicted in FIG. 6. As illustrated therein normal-orientation indicia 200 is printed on the first panel 140 and reverse-printed indicia 204 is printed on the second panel 144. "Reverse printing" is commonly used to mean printing a mirror image of a subject on to a nonviewing surface of a transparent or translucent medium. After the printed sheet construction 210 has been removed from the outfeed tray of the printer or copier 150, the user folds, as depicted by arrow 214, the second panel 144 down generally on top of the first panel 140, along the fold line 120 (or 176), to form the printed card construction as shown in FIG. 7, for example, generally at 220. In other words, the back or second face 224 of the second panel 144 with the reverse-printed indicia 204 visible thereon in a normal orientation print 228 forms the front cover 230 of the printed card construction 220. And the inside of the card construction 220 is formed by the first face 232 of the first panel 140 with the normal-orientation indicia 200 thereon.

Figure 5:
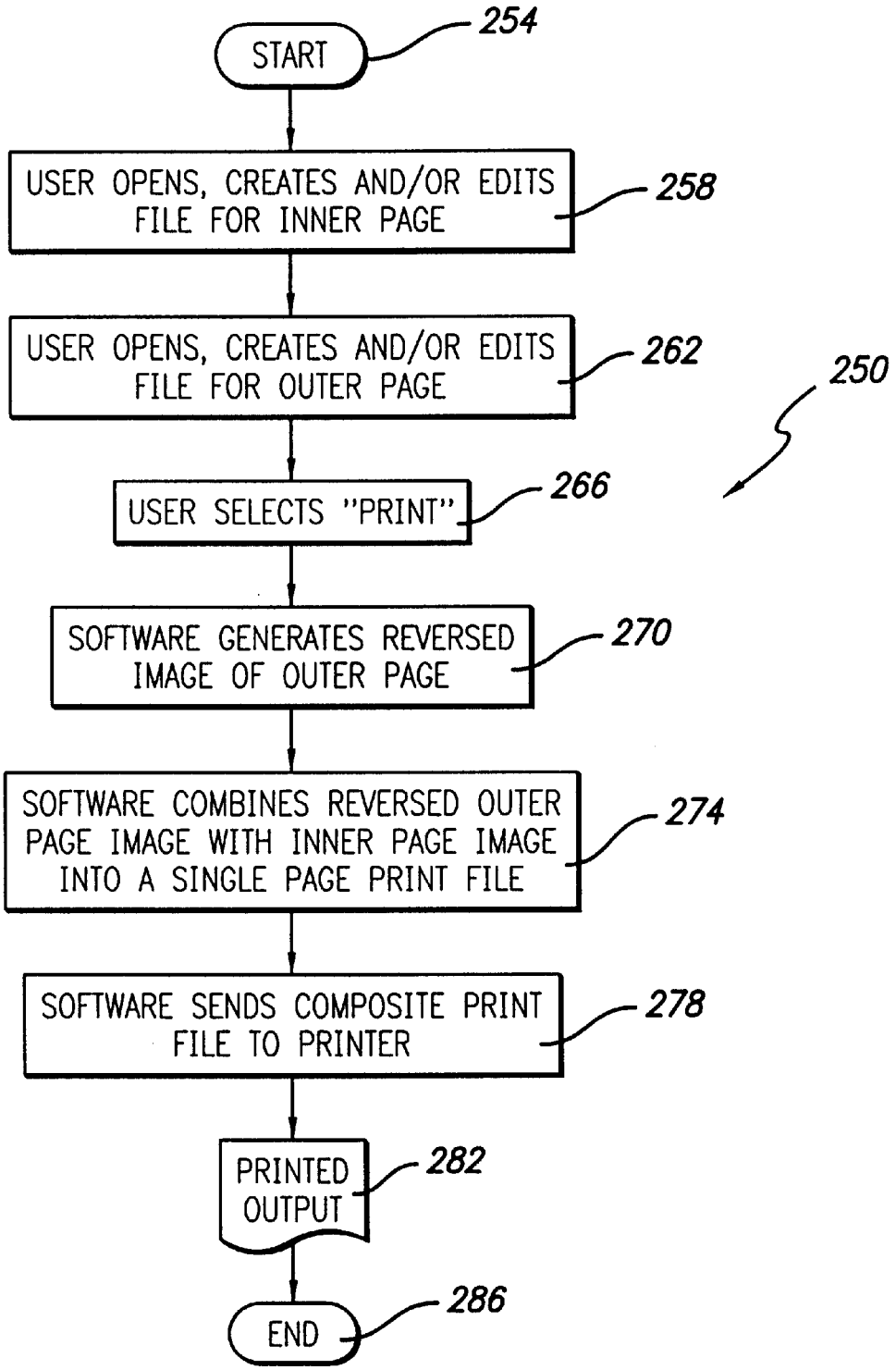
FIG. 5 is a flow chart showing a (software) process for printing a sheet construction of the present invention in the printer or copier.

FIG. 5 is a flow chart 250 showing a process for printing the sheet construction 100 by using software such as supplied on a floppy disk, and the steps therein will now be discussed. The user who has decided to start the process (Step 254) designs the normal-orientation indicia 200 on the first face 232 of the first panel 140 as shown by Step 258. Step 262 shows that the user designs the (normal orientation) indicia 228 to be visible after printing on the second face 224 of the second panel 144, that is, for the front of the outer page or cover. The user selects the "Print" command (Step 266), and the software of the system generates a reversed image of the second panel 144, as shown by Step 270. The software combines this reversed image or indicia 204 with the normal-orientation image or indicia 200 of the first panel 140 into a single-page print file pursuant to Step 274. Next (Step 278), the software sends the composite print file thereby formed to the printer 150. The output is printed on the sheet construction 100 (Step 282), and the process is completed as denoted by the End Step 286. In other words, the present software uniquely allows the user to select and edit text and graphics viewed in normal orientations and automatically reverses and flips the indicia to be reverse-printed prior to sending the print file to the user's printer 150.

With the printed card folded, as illustrated in FIG. 7 at 220, it can be appreciated that the reverse-printed indicia 204 remains on the inside surface of the front cover 230. This may be undesirable or unacceptable in some applications and/or to some users. In other words, the backlit film 106 is not totally opaque and the printed image 204 is still visible from the inside of the card, and this can be distracting. It further does not permit the inner panel (or inside surface of the front cover 230) to be used for additional personalization, indicia and/or graphics. Accordingly, a further alternative embodiment of the invention is provided herein as best illustrated in FIGS. 8 and 9 by card construction 300.

Figure 8:
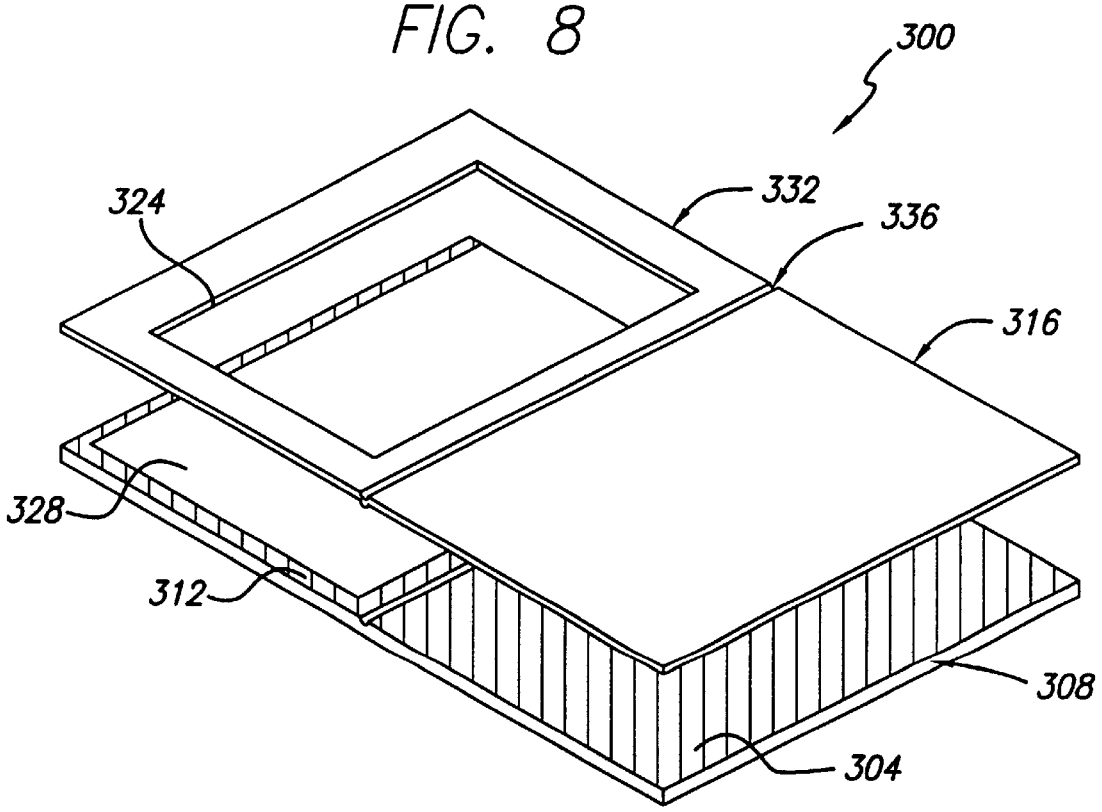
FIG. 8 is a partially-exploded perspective view of an alternative sheet construction of the present invention.

Referring first to FIG. 8, the base sheet 304 of construction 300 preferably comprises an 8½ by eleven inch panel of backlit film material 308 with the ink receptive (backlit) coating 312 disposed thereon. A facing sheet 316 of a second material 320, such as paper, has a window 324 die-cut or otherwise formed into or through one side thereof. This sheet 316 is attached to the film base sheet 316 by means of adhesive 328 applied in a pattern such that the fenestrated side of the face sheet 316 is attached only around three sides of its four-sided perimeter, and is unattached along its top edge, for example. This forms a pocket 332 having the window 324. The other side of the face sheet 316 is adhered to the base sheet over its entire area. A score line 336 is impressed into the assembly following lamination, to facilitate folding.

Figure 9:
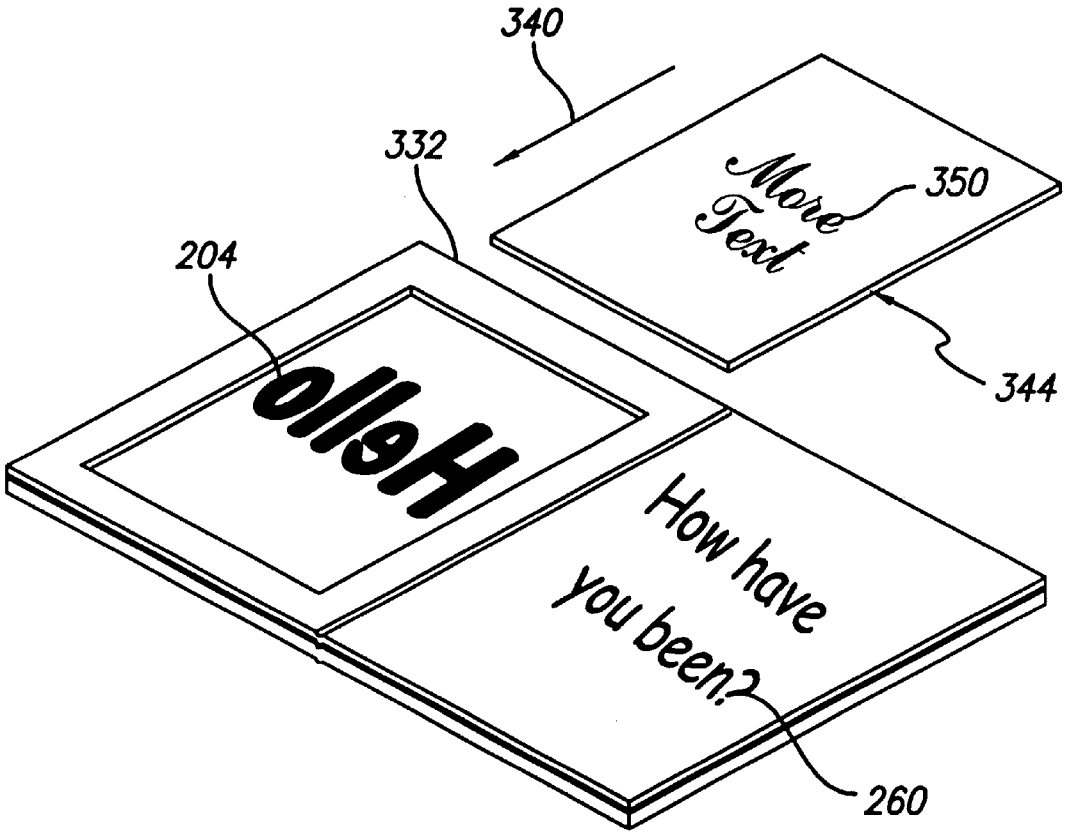
FIG. 9 is a perspective view of the sheet construction of FIG. 8 after a printing operation thereon and illustrating an opaque panel being inserted into position in the pocket of the construction.

FIG. 9 shows the construction or assembly following printing, as in the printer or copier 150 and following the steps of the process and software of FIG. 5, with reversed text and/or graphics 204 printed on the backlit film 308 exposed by the fenestration in the face sheet 316 and with the direct indicia 260 printed on the paper inner panel 316. A subsheet 344 made of opaque material, such as paper, is provided with dimensions which enable it to be easily inserted, as shown by arrow 340, into the pocket 332 formed in the fenestrated panel for a secure fit therein. This subsheet 344 can be further personalized by the user by handwriting or printing, as shown by indicia 350. It further serves to hide the reversed image 204 and eliminates show-through of interior images when viewed from the outside. The subsheet 344 can be a separate piece, supplied with the card construction assembly. Alternatively, it can be an integral portion of the face sheet, which is releasably attached by microperforations, for example.

A further alternative of this invention specifically economizes on the amount of backlit film used, a somewhat different design would use a half-sheet size face sheet. In other words, the film would be adhered pocket-wise only to the fenestrated side of the face sheet. This provides the added benefit of making the fold more flexible.

In other words, disclosed herein is a system, method and construction which enables consumers to create images viewable from both sides of a printed object, while not requiring printing on more than one side of the sheet. This is accomplished by reverse printing on some information panels and direct printing on others. The medium used is a compound construction having different imaging characteristics in different areas thereof. Software is used which selectively reverses the images to be viewed from the opposite side of the sheet just prior to printing but displays them in direct orientation for viewing and editing. Web-enabled printing can be used. The user can go to the website, choose a card design, customize it with variable information and prints it locally on the special sheet construction. The software selectively reverses only some of the image fields to print this unique backlit construction greeting card. The backlit film provides barrier protection to ink jet images that are prone to damage by water, ultraviolet light or mechanical abrasion.

Backprinting pursuant to this invention is an elegant way to provide one-sided barrier properties and the durability of a laminated structure without the expense or effort. The smooth, glossy surface of the clear film base layer also maximizes the gloss and saturation of the ink colors—photo-like image qualities.

From the foregoing detailed description, it will be evident that there are a number of changes, adaptations and modifications of the present invention which come within the province of those skilled in the art. However, it is intended that all such variations not departing from the spirit of the invention be considered as within the scope thereof.

What is claimed is:

1. A printable card construction, comprising:

a sheet construction including a first panel, a second panel and a fold line between the panels;

the sheet construction having a first face and an opposite second face;

the first panel being printable with normal-orientation indicia on the first face; and the second panel being printable on the first face with reverse-printed indicia that is visible in a print normal orientation on the second face.

2. The construction of claim 1 wherein the first panel is printable with the normal orientation indicia and the second panel is printable with the reverse-printed indicia in the same single pass through a printer or copier.

3. The construction of claim 1 wherein the fold line is a score line.

4. The construction of claim 1 wherein the fold line is a perforation line.

5. The construction of claim 1 wherein the fold line is defined by a gap between the first and second panels on the first side.

6. The construction of claim 1 wherein the sheet construction includes a backlit film base for the first and second panels and a direct printable sheet attached to the backlit film base at the first panel.

7. The construction of claim 6 wherein the sheet is attached to the base with adhesive.

8. The construction of claim 6 wherein the backlit film base includes a transparent film and a coating on the transparent film, the coating allowing ink printed thereon to be absorbed and to migrate to an interface of the coating with the transparent film such that the printed ink is visible from a side of the transparent film opposite to the interface.

9. The construction of claim 1 wherein the sheet construction includes a transparent base film, the first panel includes an opaque imageable film on the base film, and the second panel includes a backlit coating on the base film.

10. The construction of claim 9 wherein the opaque imageable film and the backlit coating are extrusion coated on the base film.

11. The construction of claim 9 wherein the fold line is defined by a gap between the opaque imageable film and the backlit coating.

12. The construction of claim 1 wherein the sheet construction is folded on the fold line such that the second face of the second panel defines a card outside front surface and the first face of the first panel defines a card inside front surface.

13. The construction of claim 1 further comprising an opaque panel positionable on the first face of the second panel in a cover position over the reverse-printed indicia.

14. The construction of claim 13 further comprising a frame attached to the sheet construction and having a slot to receive the opaque panel into the cover position.

15. The construction of claim 14 wherein the sheet construction includes a base transparent film, the first panel includes a facing sheet attached to the base transparent film, the second panel includes a backlit coating on the base transparent film, and the frame is attached on the backlit coating.

16. The construction of claim 15 wherein the facing sheet and the frame define a continuous sheet and are separated from one another by the fold line.

17. The construction of claim 16 wherein the fold line is a score line.

18. The construction of claim 16 wherein the continuous sheet is laminated to the base transparent film.

19. The construction of claim 13 wherein the opaque panel has indicia thereon.

20. The construction of claim 13 further comprising means for holding the opaque panel in the cover position after the reverse-printed indicia has been printed on the second panel.

21. A printed card construction, comprising:

a sheet construction having on a first face thereof a first portion and a second portion;

normal-orientation indicia printed on the first portion;

reverse-printed indicia on the second portion, the reverse-printed indicia being visible on an opposite second face of the second portion as normal oriented indicia; and a blocking panel positionable in a cover position covering the reverse-printed indicia on the second portion.

22. The construction of claim 21 wherein the sheet construction includes a fold line separating the first and second portions.

23. The construction of claim 21 further comprising a pocket attached to the sheet construction and adapted to hold the blocking panel in the cover position.

24. The construction of claim 23 wherein the pocket includes a four-sided frame, three of whose sides are secured to the sheet construction, and a fourth of which defines an opening of the pocket, the frame encircling the reverse-printed indicia.

25. The construction of claim 21 wherein the blocking panel is a sheet of paper.

26. The construction of claim 21 wherein the second portion comprises a backlit film construction.

* * * * *